US005642541A

United States Patent [19]

Corbin

[11] Patent Number: 5,642,541

[45] Date of Patent: Jul. 1, 1997

[54] BEDSIDE READING TABLE

[76] Inventor: William B. Corbin, 4920 Highway 161, Springfield, Tenn. 37172

[21] Appl. No.: 394,446

[22] Filed: Feb. 27, 1995

[51] Int. Cl.[6] ..... A47B 23/00

[52] U.S. Cl. ..... 5/507.1; 5/659; 5/658; 108/49

[58] Field of Search ..... 5/426, 504.1, 505.1, 5/507.1, 658, 659, 661; 108/49

[56] References Cited

U.S. PATENT DOCUMENTS

| | | | |
|---|---|---|---|
| 3,196,468 | 7/1965 | McWilliams | 5/505.1 |
| 3,698,328 | 10/1972 | Weir | 108/6 |
| 3,894,709 | 7/1975 | Weir | 248/445 |
| 3,906,648 | 9/1975 | Bard | 38/102 |
| 4,214,327 | 7/1980 | Smith | 5/426 X |
| 4,313,589 | 2/1982 | Vega | 248/558 |
| 4,465,255 | 8/1984 | Hill | 248/441.4 |
| 4,561,549 | 12/1985 | Yokohori | 5/658 X |
| 4,848,710 | 7/1989 | Newman | 248/129 |
| 5,009,379 | 4/1991 | Sadler | 108/49 |
| 5,038,434 | 8/1991 | Navarette | 5/507 |
| 5,161,766 | 11/1992 | Arima | 248/447 |
| 5,359,741 | 11/1994 | Lang | 108/49 X |

FOREIGN PATENT DOCUMENTS

| | | | |
|---|---|---|---|
| 486800 | 9/1952 | Canada | 5/505.1 |

*Primary Examiner*—Michael F. Trettel

[57] ABSTRACT

The present invention discloses a bedside reading tray or table. The base of table is preferably inserted into the space between the mattress and the box springs. The weight of the mattress provides stability for the proportion of the tray. Attached to the base, there is a neck which rises substantially vertically from the base. Attached to the base there is a sill. Attached to sill, there is a tray. The sill keeps items placed on the tray from sliding off. The tray is tilted to so that materials may be placed on it and may be read and written upon. Preferably, the entire table is of one piece construction.

13 Claims, 3 Drawing Sheets

BEDSIDE READING TABLE

BACKGROUND OF THE INVENTION

The present invention relates generally to a reading table and more particularly to a reading table which cooperates with a bed to provide a bedside reading table.

It will be appreciated by those skilled in the art that many individuals, especially youths, like to read and study in bed. Parents may spend a lot of money purchasing desks. However, desks often remain unused. Further, in a prone position, individuals often have difficulty in reading or writing. Mattresses rarely provide a sufficiently hard surface to allow writing. To this end, there have been several attempts to provide devices for reading and writing in bed.

For example, U.S. Pat. No. 4,313,589 issued to A. Vega on Feb. 2, 1982, discloses a tray having legs which, in the reverse position, can be slid under the bed. Unfortunately, this is a very bulky and overly large tray.

U.S. Pat. No. 3,906,648 issued to D. Bard on Sep. 23, 1975, discloses a needlepoint device that works in connection with a chair but is not intended to work in connection with a bed.

U.S. Pat. No. 3,894,709 issued to S. Weir on Jul. 15, 1975, discloses a reading table having legs which slide under a bed or other work piece. It is large and cumbersome and has many moving parts.

U.S. Pat. No. 3,698,328 issued to S. Weir on Oct. 17, 1972, discloses a reading table which resides under the user. This device requires the weight of the user to hold the device in place which can be very uncomfortable. Additionally, it has many moveable parts which are unnecessary in certain applications.

U.S. Pat. No. 4,465,255 issued to D. Hill on Aug. 14, 1984, discloses an inverse reading table which is intended to be used by the infirmed which places a book overhead. This device can not be used for writing as the tray is transposed between the user and the book.

U.S. Pat. No. 4,848,710 issued to D. Newman on Jul. 18, 1989, discloses a complex computer support device which resides on top of a bed.

U.S. Pat. No. 5,038,434 issued to P. Navarrette on Aug. 13, 1991, discloses a bedside tray which is in a horizontal position as opposed to a needed angled position. The substantially horizontal position of the tray does not allow the individual to use it in any reclined position other than for a tray to put something such as a food or drink on.

U.S. Pat. No. 5,161,766 issued to R. Arima on Nov. 10, 1992, discloses a portable work station which is overly complex and necessarily cumbersome. Further, as opposed to placing the books and writing material to the side of the bed, it brings them over the bed.

What is needed, then, is a bedside reading table. This needed table must be portable. This needed table must be low cost and capable of one-piece plastic construction. This needed table must not be mechanically complex and must be simple. The needed table must have an angle which allows easy placement of books and writing tablets and the like but makes it difficult for holding drinks and food which one would not want to spill on one's bed. This needed table must be comfortable to use and easy to store under the bed. This needed table must require no assembly, no maintenance, and no repair. This needed table must remove the requirement of the space needed for a desk. This device is presently lacking in the prior art.

SUMMARY OF THE INVENTION

The present invention discloses a bedside reading tray or table. The base of table is preferably inserted into the space between the mattress and the box springs. The weight of the mattress provides stability for the proportion of the tray. Attached to the base, there is a neck which rises substantially vertically from the base in an operative position. Attached to the base there is a sill. Attached to sill, there is a tray. The sill keeps items placed on the tray from sliding off the tray. The tray is tilted so that materials may be placed on it may be read and written upon. Preferably, the entire table is of one piece construction.

One object of the present invention is to provide a bedside reading table.

A still further object of the present invention is to provide a bedside reading table which is portable.

A still further object of the present invention is to provide a device which is low cost and can be constructed in one piece.

A still further object of the present invention is to provide a device which is not mechanically complex.

A still further object of the present invention is to provide a tray which resides at the appropriate angle for reading and writing yet discourages the user from placing drinks and food on it.

A still further object of the present invention is to provide a device which is comfortable to use on a bed.

A still further object of the present invention is to provide a device which is easily stored underneath the bed.

A still further object of the present invention is to provide a device in which no assembly is required.

A still further object of the present invention is to provide a device which requires neither maintenance nor repair.

A still further object of the present invention is to provide a device which removes the need for a desk or a table.

DESCRIPTION OF THE PREFERRED EMBODIMENT

Figure 1:
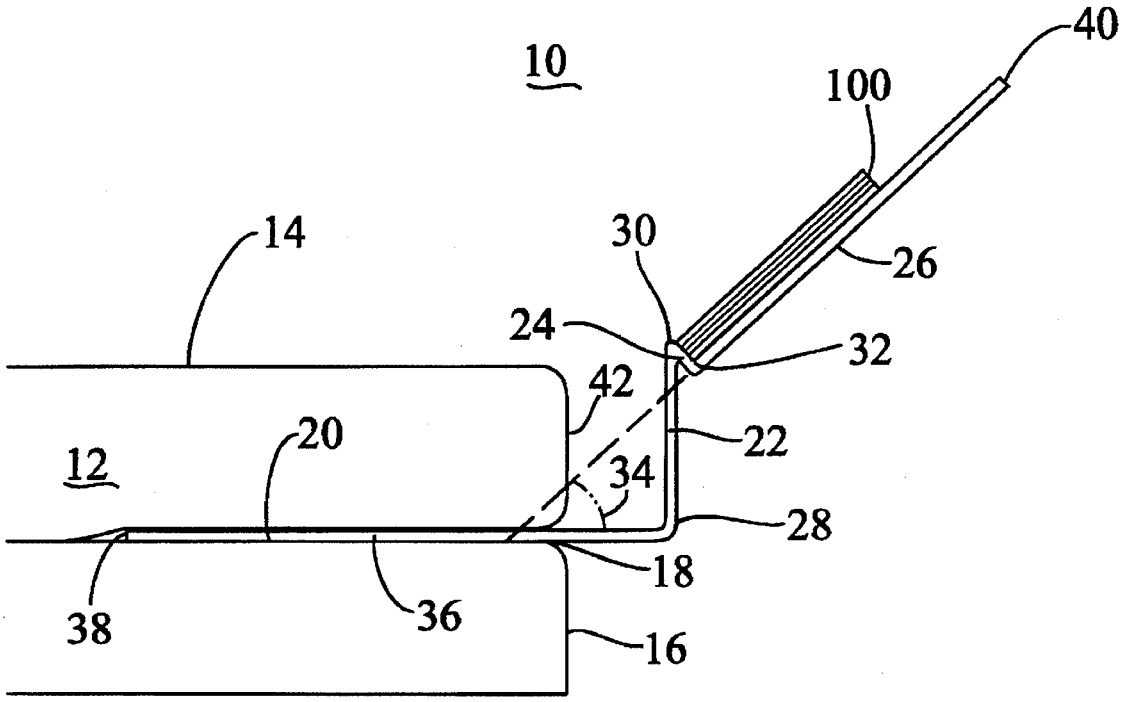
FIG. 1 is a side view showing the table of the present invention as it cooperates with a bed.

Referring now to FIG. 1, there is shown generally at 10 the bedside reading table of the present invention. As can be seen in FIG. 1, base 20 of table 10 is preferably placed into space 18 between mattress 14 and box spring 16 of bed 12. The weight of mattress 14 and possibly user (50 is FIG. 3) on base 20 provides stability for placement of items on tray 26. Attached to base 20 at base angle 28 there is neck 22. In the preferred embodiment, when base 20 is substantially horizontal along with bed 12, neck 22 rises substantially vertical to follow substantially the direction of edge 42 of mattress 14. Sill 24 joins tray 26 and neck 22. Sill 24 is attached to neck 22 at neck angle 30. Tray 26 is attached to sill 24 at sill angle 32. Tray angle 34 is preferably placed at an angle which holds a book and the like on tray 26 but does not readily hold food and drink. Tray angle 34 is measured from horizontal or base 20 based upon a line extending along tray 26 until it intercepts base 20. In the preferred embodiment, proximal end 38 of device 10 is placed in space 18 and distal end 40 lies away from and distally from proximal end 38.

Figure 2:
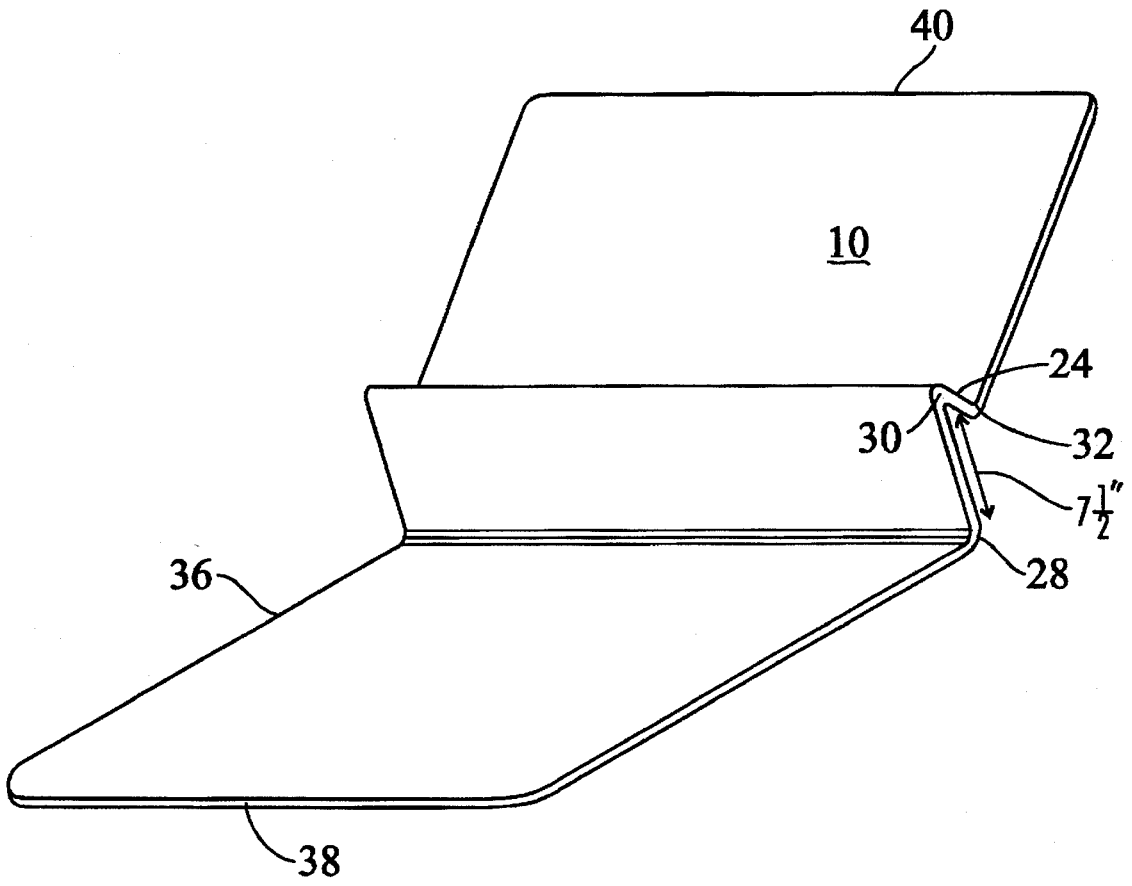
FIG. 2 is a perspective view of the device of the present invention.

Referring now to FIG. 2, one can better see the arrangement of device 10. In the preferred embodiment, base side 36 running from proximal end 38 to base angle 28 is approximately thirteen (13) inches. Neck 22 is approximately seven and a half (7½) inches tall from base angle 28 to neck angle 30. Sill 24 is approximately one and one-half inches from neck angle 30 to sill angle 32. Tray 26 is approximately twenty two (22) inches wide along distal end 40.

Figure 3:
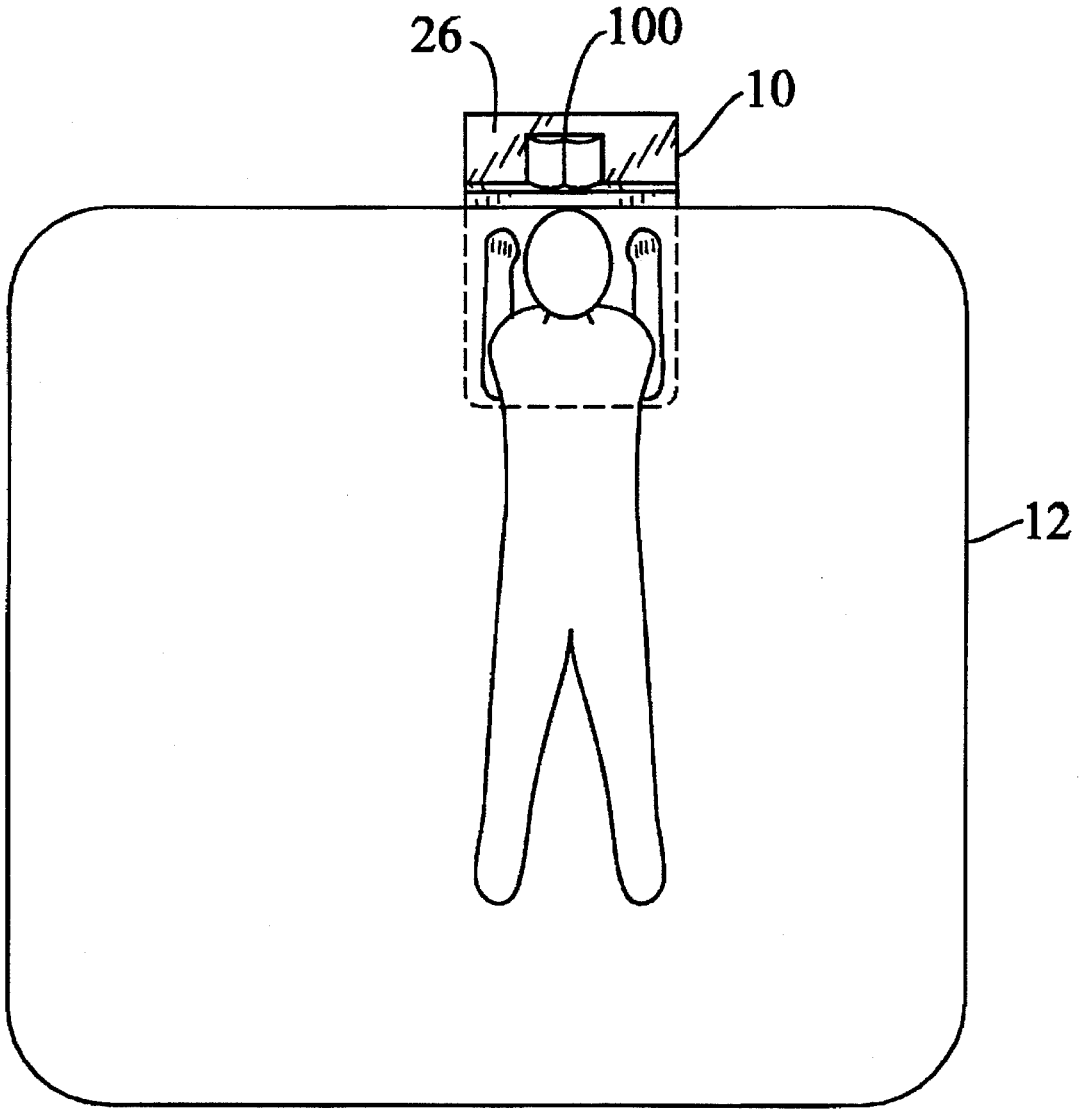
FIG. 3 is a plan view showing how the table of the present invention cooperates with a bed.

Referring now to FIG. 3, one can see how device 10 cooperates with user 50 on bed 12. Tray 26 is aligned to reside next to bed 12 so that user 50 can read and write on work piece 100. Although user 50 is shown in a face-down position, device 10 also works well when user 50 is on his or her side.

Preferably, device 10 is one quarter inch plastic which is heated to temperatures of approximately 280° and bent to the desired angles. However, device 10 can also be extruded. Preferably, device 10 is transparent and may contain a design such as a school logo. However, the plastic may be translucent or opaque and be colored.

Thus, although there have been described particular embodiments of the present invention of a new and useful bedside reading table, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A reading table received by a space between a mattress and a box spring of a bed comprising:

a. a base received by said space;

b. a neck attached to said base;

c. a sill attached to said neck;

d. a tray attached to said sill; and e. wherein said tray is aligned at an acute tray angle from said base.

2. The device of claim 1 wherein said device is integrally molded from plastic.

3. The device of claim 1 wherein said device is integrally formed from plastic.

4. The device of claim 1 wherein said device is integrally extruded from plastic.

5. A device for supporting a work piece comprising:

a. a bed having a mattress and a box spring separated by a space;

b. a base having a distal end received by said space;

c. a neck attached to said base at a base angle;

d. a sill attached to said neck at a neck angle;

e. a tray attached to said sill at a sill angle; and f. wherein said tray is aligned at an acute tray angle from said base.

6. The device of claim 5 wherein said device is integrally molded from plastic.

7. The device of claim 5 wherein said device is integrally formed from plastic.

8. The device of claim 5 wherein said device is integrally extruded from plastic.

9. The device of claim 5 wherein said neck parallels an edge of said mattress.

10. The device of claim 5 wherein said base angle is substantially ninety degrees.

11. The device of claim 5 wherein said sill angle is substantially ninety degrees.

12. The device of claim 5 wherein said tray angle is configured to hold a book.

13. A device received by a space between a mattress and a box spring of a bed for supporting a work piece comprising an integrally formed table having a base, a neck, a sill, and a tray, said base having a proximal end placeable within said space, said base joined to said neck at a base angle of substantially ninety degrees, a sill joined to said neck distally from said base at a neck angle, a tray joined to said sill distally from said neck at a sill angle, and said tray aligned at an acute tray angle with respect to said base.

* * * * *